US009612547B2

(12) United States Patent
Ooyoshi

(10) Patent No.: US 9,612,547 B2
(45) Date of Patent: Apr. 4, 2017

(54) DEVELOPING DEVICE, PROCESS CARTRIDGE, AND IMAGE FORMING APPARATUS

(71) Applicant: Hirobumi Ooyoshi, Kanagawa (JP)

(72) Inventor: Hirobumi Ooyoshi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/052,116

(22) Filed: Feb. 24, 2016

(65) Prior Publication Data

US 2016/0259271 A1 Sep. 8, 2016

(30) Foreign Application Priority Data

Mar. 5, 2015 (JP) ..... 2015-044017
Oct. 13, 2015 (JP) ..... 2015-202261

(51) Int. Cl.
*G03G 15/08* (2006.01)

(52) U.S. Cl.
CPC ..... *G03G 15/0817* (2013.01); *G03G 15/0898* (2013.01)

(58) Field of Classification Search
CPC ..... G03G 15/0898; G03G 15/0817
See application file for complete search history.

(56) References Cited

U.S. PATENT DOCUMENTS

2009/0169265 A1 7/2009 Yoshida et al.
2010/0150603 A1* 6/2010 Sakamoto ..... G03G 15/0898 399/103
2010/0202796 A1 8/2010 Ooyoshi et al.
2011/0052255 A1 3/2011 Yoshida et al.
2013/0183065 A1 7/2013 Nakamura et al.
2014/0064778 A1* 3/2014 Uneme ..... G03G 21/1832 399/103

FOREIGN PATENT DOCUMENTS

JP 3-155576 7/1991
JP 9-101677 4/1997
JP 2006-018082 1/2006

* cited by examiner

*Primary Examiner* — Sandra Brase
(74) *Attorney, Agent, or Firm* — Harness, Dickey & Pierce, P.L.C.

(57) ABSTRACT

A developing device includes a developer bearer, an end seal, and an inlet seal. The end seal is disposed in contact with a circumferential surface of each end of the developer bearer in a longitudinal direction of the developer bearer. The inlet seal includes a center portion in the longitudinal direction disposed in contact with the developer bearer and each end in the longitudinal direction disposed in contact with the end seal. The end seal includes a cutout portion at a side closer to the center portion in the longitudinal direction and at an upstream side in a direction of rotation of the developer bearer. The inlet seal covers an edge of the cutout portion in the longitudinal direction.

12 Claims, 8 Drawing Sheets

DEVELOPING DEVICE, PROCESS CARTRIDGE, AND IMAGE FORMING APPARATUS

CROSS-REFERENCE TO RELATED APPLICATIONS

This patent application is based on and claims priority pursuant to 35 U.S.C. §119(a) to Japanese Patent Applications No. 2015-044017, filed on Mar. 5, 2015, and No. 2015-202261, filed on Oct. 13, 2015, in the Japan Patent Office, the entire disclosure of which is hereby incorporated by reference herein.

BACKGROUND

Technical Field

Aspects of the present disclosure relate to a developing device, a process cartridge, and an image forming apparatus.

Related Art

Electrophotographic image forming apparatuses include a developing device that develops an electrostatic latent image with developer to form a visible image. The developing device has a configuration, such as seals provided at both ends in a longitudinal direction of a developer bearer to prevent the developer in the developing device from being carelessly scattered into peripheral portions of the developer bearer.

The seals are provided in contact with a surface of the developer bearer at both ends of the developer bearer in the longitudinal direction to prevent leakage of the developer in the longitudinal direction, thus preventing the developer from being scattered to the outside of each end in the longitudinal direction. To prevent leakage of the developer in the developing device to the outside even in the center in the longitudinal direction, it is desirable to provide other seals along the longitudinal direction. To prevent scattering of the developer, it is desirable to arrange the seals to overlap in respective ends in the longitudinal direction. However, if the seals are simply arranged to overlap, the developer borne by the surface of the developer bearer is dammed up in a portion where the seals overlap, and the dammed developer may be scattered.

SUMMARY

In an aspect of the present disclosure, there is provided a developing device that includes a developer bearer, an end seal, and an inlet seal. The end seal is disposed in contact with a circumferential surface of each end of the developer bearer in a longitudinal direction of the developer bearer. The inlet seal includes a center portion in the longitudinal direction disposed in contact with the developer bearer and each end in the longitudinal direction disposed in contact with the end seal. The end seal includes a cutout portion at a side closer to the center portion in the longitudinal direction and at an upstream side in a direction of rotation of the developer bearer. The inlet seal covers an edge of the cutout portion in the longitudinal direction.

In another aspect of the present disclosure, there is provided a process cartridge that includes a latent image bearer and the developing device. The latent image bearer bears a latent image. The developing device includes the developer bearer, to supply developer to the latent image on the latent image bearer to form a visible image on the latent image bearer.

In still another aspect of the present disclosure, there is provided an image forming apparatus that includes the process cartridge.

In still yet another aspect of the present disclosure, there is provided an image forming apparatus that includes the developing device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
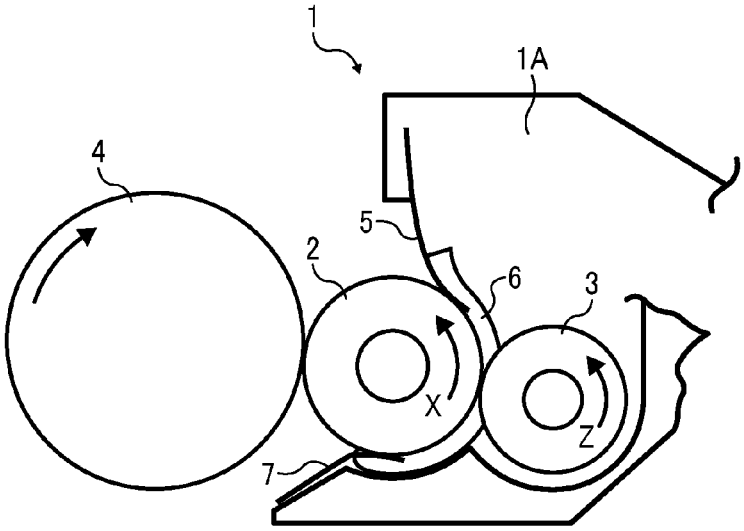
FIG. 1 is a schematic view for describing an example of a developing device according to an embodiment of the present invention.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments for implementing the present invention will be described by reference to the drawings. As illustrated in FIG. 1, a developing device 1 includes a developing chamber 1A, a developer bearer 2, a part of which facing a photoconductor drum 4 as a latent image bearer is exposed outside the developing chamber 1A, and which bears a developer on a surface, and a developer supplier 3 arranged in the developing chamber 1A, and which supplies the developer in the developing chamber 1A to the developer bearer 2. The developing device 1 includes a regulation blade 5 that regulates the developer borne by the developer bearer 2 and to be supplied to the photoconductor drum 4 to a predetermined bearing amount. The developing device 1 includes an end seal 6 and an inlet seal 7 as members for preventing scattering of the developer due to leakage in a Y direction illustrated in FIG. 2 that is a longitudinal direction vertical to the sheet surface of FIG. 1. The Y direction is an axial direction of the developer bearer 2, perpendicular to an X direction as a predetermined direction illustrated by the arrow in FIG. 1, which is a predetermined direction of rotation of the developer bearer 2.

The developer bearer 2 is a roller including a rubber layer on a surface and rotatably provided in the X direction. In the present embodiment, as the developer borne by the developer bearer 2, a one-component magnetic developer is used, for example. The developer drawn up from the developer supplier 3 and borne by the developer bearer 2 in the process where the developer bearer 2 is rotated in the X direction is supplied to the photoconductor drum 4. The developer supplier 3 is a sponge roller to which a direction of rotation of being moved to a conflicting Z direction at a position opposite to the developer bearer 2 is set. However, the developer supplier 3 may be formed of another material as long as the material is an elastic member.

The regulation blade 5 may be an elastic member contactable with the surface of the developer bearer 2 by a predetermined pressure, to be specific, a flat metal spring. However, another material may be used as long as the material is an elastic member. The regulation blade 5 regulates the developer on the surface of the developer bearer 2 to be a predetermined thickness, and prompts friction contact of the developers that pass between the regulation blade 5 and the developer bearer 2 and frictionally charges the developer.

Figure 2:
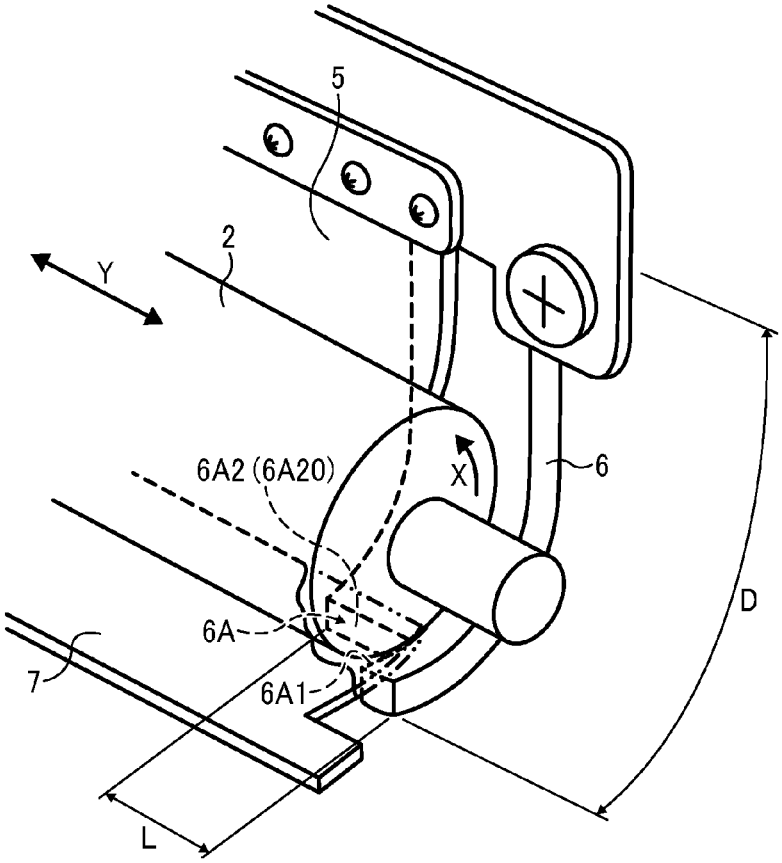
FIG. 2 is a partial perspective view for describing an installation state of an end seal and an inlet seal having an opposing relationship illustrated in FIG. 1, based on one end of a developer bearer in a longitudinal direction, according to an embodiment.
Figure 3:
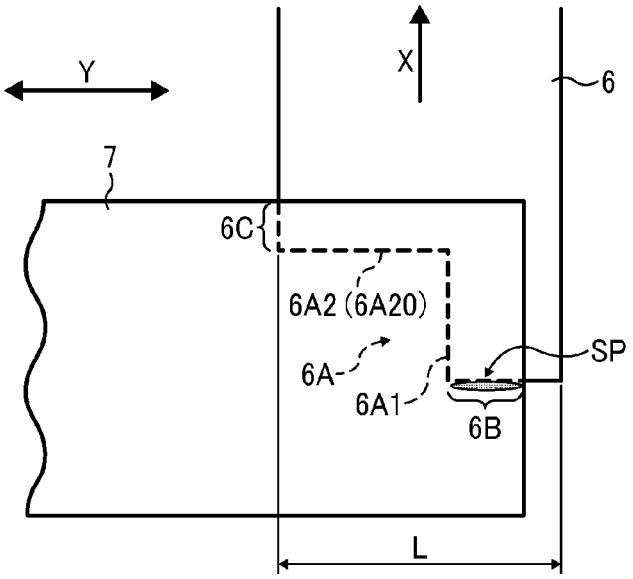
FIG. 3 is a developed view for describing the opposing relationship between the end seal and the inlet seal illustrated in FIG. 2, according to an embodiment.

A pair of the end seals 6 is provided facing respective ends of the developer bearer 2 in the Y direction (see FIG. 2). The end seal 6 extends in the X direction as illustrated in FIGS. 2 and 3, and has predetermined widths D and L in the X direction and in the Y direction, respectively, as maximum widths, on a surface facing the developer bearer 2. The end seals 6 are in contact with circumferential surfaces of both ends of the developer bearer 2 in the Y direction (in a contact range CR2 in FIG. 4), and fill gaps between the developer bearer 2 and the developing chamber 1A along the circumferential surface of the developer bearer 2. As described above, the end seals 6 are members used to shield the developer leaked through the respective ends of the developer bearer 2 in the Y direction. As the end seals 6, a structure in which felt or a brush having a high sliding property is layered on a surface of a base layer such as sponge, or a structure only with the felt or the brush is used, in order to enhance adhesiveness between the end seals 6 and the developer bearer 2.

Figure 4:
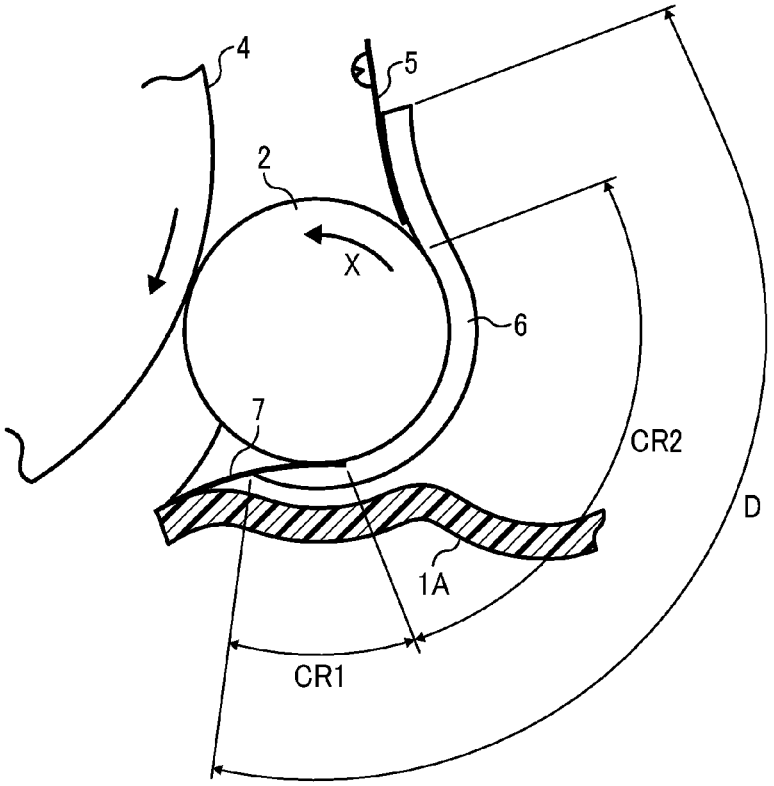
FIG. 4 is a schematic view illustrating an arrangement of the end seal and the inlet seal included in the developing device illustrated in FIG. 1, as viewed from an end side of the inlet seal in the longitudinal direction, according to an embodiment.

The inlet seal 7 extends in the Y direction, a center portion of the inlet seal 7 in the Y direction is in contact with the developer bearer 2, and ends of the inlet seal 7 in the Y direction are in contact with the end seals 6. The ends of the inlet seal 7 in the Y direction are interposed between the developer bearer 2 and the end seals 6, as illustrated in FIG. 4.

The inlet seal 7 has a base end directly joined with the developing chamber lA throughout the entire area in the Y direction by a double-sided adhesive tape or an adhesive, and has a free end in contact with the developer bearer 2 by a pressure with which the developer after development can be collected into the developing chamber lA without being scraped off from the developer bearer 2. As the inlet seal 7, a polyethylene terephthalate (PET) sheet material is used, which has plasticity or elasticity with which the free end is contactable with the developer bearer 2 with a pressure that prevents the developer from being leaked from the developing chamber 1A, in addition to collection of the developer. The base end of the inlet seal 7 is directly glued to the developing chamber 1A side such that ends of the free end in the Y direction (see FIG. 2) are in contact with the developer bearer 2, and ends of an opposite surface in the X direction are in contact with the end seals 6. The free end of the inlet seal 7 is in contact with the developer bearer 2 in a contact range (indicated by CR1 in FIG. 4) of the inlet seal 7 and the end seals 6, using the thickness of the end seals 6.

Figure 11:
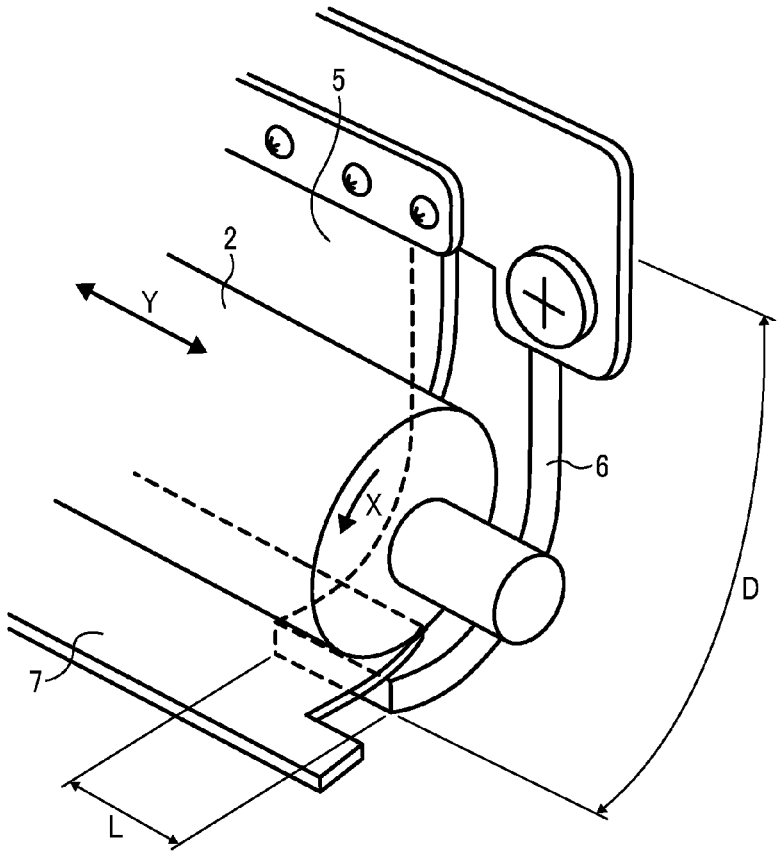
FIG. 11 is a partial perspective view for describing a virtual example of an arrangement of the end seal and the inlet seal illustrated in FIG. 2, based on one end of the developer bearer in the longitudinal direction, according to an embodiment.

As illustrated in FIG. 3, the end seal 6 includes a cutout portion 6A having a predetermined width L of the end seal 6 or less in the Y direction, at a side closer to the center portion in the Y direction (an inner side of the developing device) and at an upstream side of the end seal 6 in the X direction. Therefore, since the cutout portion 6A exists, compared with the case where the width in the Y direction is L (see FIG. 11), the end seal 6 has a smaller contact area than an opposing area to the inlet seal 7 (a contact area of a case without the cutout portion 6A).

In FIGS. 2 and 3, the cutout portion 6A includes a parallel edge 6A1 parallel to the X direction, and a crossing edge 6A2 headed from a downstream-side end of the parallel edge 6A1 in the X direction toward the center portion in the Y direction. The crossing edge 6A2 is a perpendicular edge (for convenience, illustrated by the reference code 6A20) perpendicular to the parallel edge 6A1.

The inlet seal 7 is in contact with the end seal 6 in a state of covering at least an edge (the parallel edge 6A1 and the crossing edge 6A2) of the cutout portion 6A. To be specific, the inlet seal 7 covers the end seal 6 in a state of surrounding the edge of the cutout portion 6A in the X direction and in the Y direction to form covered portion 6B and 6C, as illustrated in FIG. 3. The covered portion 6B is an end-side portion of the cutout portion 6A of the end seal 6 in the Y direction, the portion being covered with the inlet seal 7, and is a most upstream-side portion of the end seal 6 in the X direction. The covered portion 6C is a downstream-side portion of the cutout portion 6A of the end seal 6 in the X direction, the portion being covered with the inlet seal 7, and is a most center-side portion of the end seal 6 in the Y direction. As illustrated in FIG. 3, the length of the covered portion 6B is set to roughly about 3 mm among the end seal 6, the inlet seal 7, and the developing chamber 1A (see FIG. 4) in order to secure an application margin of a sealant (encapsulant) for stopping the leakage of the developer along the Y direction. Note that, in FIG. 3, the application margin of the sealant is displayed as sealant application position SP. The range of the sealant application position SP is the covered portion 6B at an extreme end in the Y direction, which is far from the inside of the developing device, because the sealant is deformed by the heat of the developer. The length of the covered portion 6C of the end seal 6 in the X direction may just be roughly about 1 mm, because a small supporting area may just need to be secured to place and support the inlet seal 7 in an easily bendable state. The length of the covered portion 6C is made as small as possible, as described above, so that the inlet seal 7 is made more easily bendable in a direction of filling the cutout portion 6A at a position facing the cutout portion 6A while dropout of the inlet seal 7 from the end seal 6 is prevented. In other words, the inlet seal 7 facing the cutout portion 6A is easily bent to the cutout portion 6A side due to non-existence of backing of the end seal 6. Therefore, when the developer proceeds between the developer bearer 2 and the inlet seal 7, the inlet seal 7 is bent in a direction of being pressed by the developer and escaped, and an increase in pressure at a forming position of the cutout portion 6A is reduced.

The bearing range of the developer in the Y direction of the developer bearer 2 is a range between the end seals 6. However, in the bearing range of the developer in the Y direction (inner sides of the both ends of the developer bearer 2 in the Y direction), the developer may flow into the Y direction due to rotary movement or the like of the developer bearer 2. This causes the developer leakage at the ends. Especially, in a case of a method of bearing the developer using a magnetic brush, a line of magnetic force expands outside in the Y direction, and thus the developer may flow into an outside in the Y direction to the range where the end seal 6 is positioned. If a part of the developer enters between the developer bearer 2 and the inlet seal 7 in the range where the end seal 6 is positioned, the inlet seal 7 is pressed by the developer, and the pressure of the portion is increased. In a case of employing the configuration illustrated in FIG. 11, where no cutout portion 6A is provided, if the pressure in the portion where the developer is positioned is increased by being subject to reaction force from the backed portion, the developer is dammed up, and is impeded to pass a leading end (free end) of the inlet seal 7 and moved into the developing chamber 1A, and the developer is dammed up. If the developer is dammed up, the pressure is further increased by the developer that is moved to the position afterward, and the developer is leaked outside the developing device.

Figure 12:
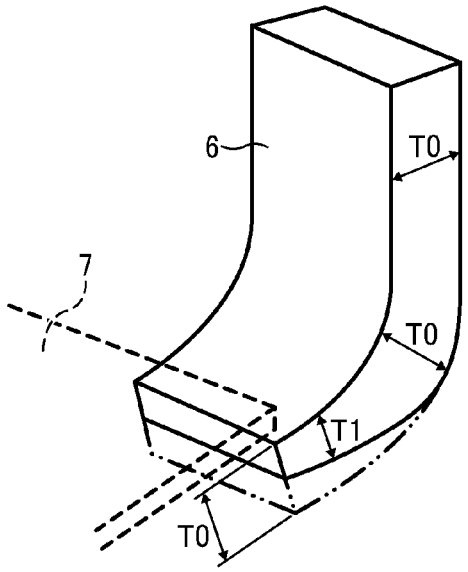
FIG. 12 is a perspective view for describing a problem in the virtual example of the end seal, according to an embodiment.

Therefore, as illustrated in a virtual example of FIG. 12, a configuration can be considered, in which the thickness T1 of the surface of the end seal 6 with which the inlet seal 7 is in contact is changed to become thinner at the upstream side in the X direction than the thickness T0 of a portion of the end seal 6 at a downstream side in the X direction, and a pressure of a portion of the inlet seal 7, which is in contact with the end seal 6, and a pressure of a portion of the inlet seal 7, which is not in contact with the end seal 6, in the Y direction, are balanced. However, to employ this configuration, a processing state of the material used for the end seal 6 needs to be finely changed, and an increase in cost is incurred. Furthermore, when the thickness of the sponge used for the base layer of the end seal 6 is thin, processing becomes difficult, and a desired result cannot be obtained. Further, change of the material of the end seal 6 itself may be considered, instead of the change of the thickness by the change of the surface configuration of the end seal 6.

However, in a case of manufacturing the end seal 6 with a resin mold, difficulty in manufacturing the resin mold is high, and an increase in cost cannot be avoided. In a case where the inlet seal 7 is made more easily bendable by the change of the thickness or the material of the end seal 6, a moving space of the inlet seal 7 becomes wide in the end of the developer bearer 2 in the Y direction, due to the change. Therefore, the developer is leaked outside the end in the Y direction.

In contrast, in the configuration of the present embodiment illustrated in FIGS. 2 and 3, the cutout portion 6A is provided at the inner side of the developing device of the end seal 6 (at the side closer to the center portion in the Y direction), and a difference in contact area with respect to the opposing area is made, so that the increase in pressure is reduced and 3 0 scattering of the developer can be prevented or suppressed, with the simple configuration that easily causes the bending in the non-contact portion. That is, the inlet seal 7 is made easily bendable by facing the cutout portion 6A of the end seal 6 side. Therefore, the increase in pressure between the developer bearer 2 and the inlet seal 7 caused due to pressing of the developer can be reduced. Therefore, the developer moved from the developer bearer 2 side can be easily collected into the developing chamber 1A, and the scattering of the developer from the end of the developer bearer 2 in the Y direction and the scattering of the developer to the periphery of a developing position can be prevented or suppressed by the end seal 6.

Meanwhile, in the present embodiment, in causing the inlet seal 7 to be in contact with the end seal 6 in a state of covering the edge of the cutout portion 6A in the end seal 6, the following configuration is employed. That is, the inlet seal 7 covers the end seal 6 to include the cutout portion 6A in the Y direction and in the X direction. By providing the overlapping portion of the covered portions 6B and 6C, no gap into which the developer enters is provided between the cutout portion 6A and the inlet seal 7.

Figure 5A:
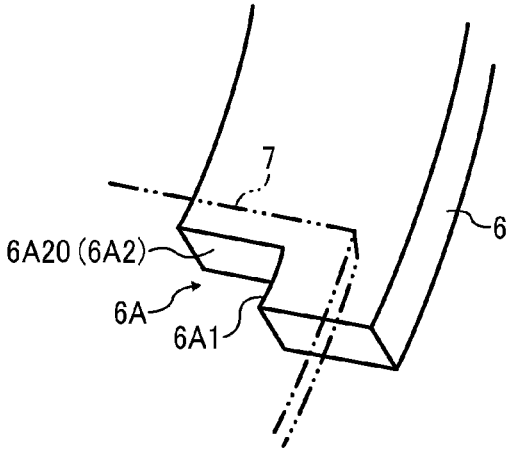
FIGS. 5A to 5D are perspective views for describing a difference in an action between the arrangement of the end seal and the inlet seal illustrated in FIG. 2, and a case without using the arrangement, according to an embodiment.
Figure 5B:
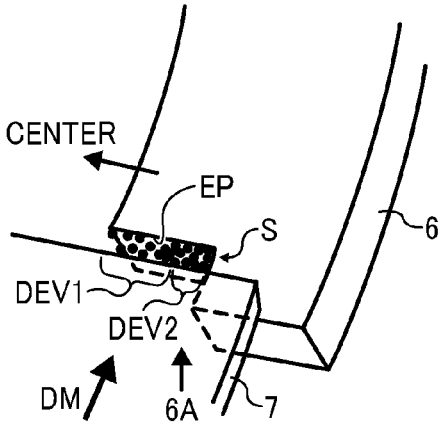
Figure 5C:
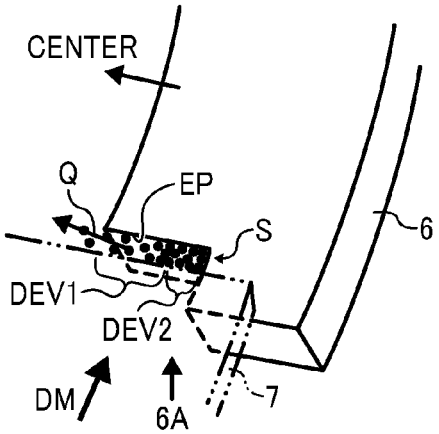
Figure 5D:
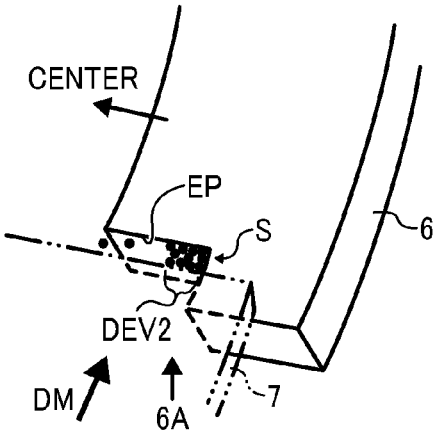

Accordingly, as illustrated in FIG. 5A, the inlet seal 7 covers at least the edge of the cutout portion 6A of the end seal 6, so that a gap S into which the developer enters, as illustrated in FIG. 5B, is not formed between the inlet seal 7 and the cutout portion 6A. If the gap S exists, the developer is scraped off by an edge portion EP of the edge of the cutout portion 6A and is sometimes deposited in the gap S when the developer is moved in a direction indicated by arrow DM with the rotation of the developer bearer 2 in the X direction (see FIG. 3). The developer (indicated by DEV1 in FIG. 5B) existing at a side of the gap S closer to a center (CENTER in FIG. 5B) of a developing area in the Y direction of the cutout portion 6A is pushed away and overflows when a following developer enters the gap S, and is moved toward the center (CENTER in FIG. 5C) of the developing area, as illustrated by arrow Q in FIG. 5C. In contrast, the developer (indicated by DEV2 in FIG. 5C) deposited in an end side of the gap S in the Y direction does not easily overflow, and often remains deposited, and is solidified as a result, as illustrated in FIG. 5D. The solidified developer scrapes off the developer moved in the X direction, and an amount of deposition in that portion is sometimes increased. The solidified developer by the increase in the amount of deposition becomes a cause to generate an abnormal image such as streaks on an image by damaging the surface of the developer bearer 2, and scraping the developer borne by the developer bearer 2.

As described above, the cutout portion 6A of the end seal 6 is covered with the inlet seal 7, so that damage to the developer bearer 2 can be prevented or suppressed, and further, occurrence of an abnormal image such as streaks can be prevented or suppressed. Therefore, performance to prevent the scattering of the developer to the peripheral portion of the developing device is improved.

Figure 6:
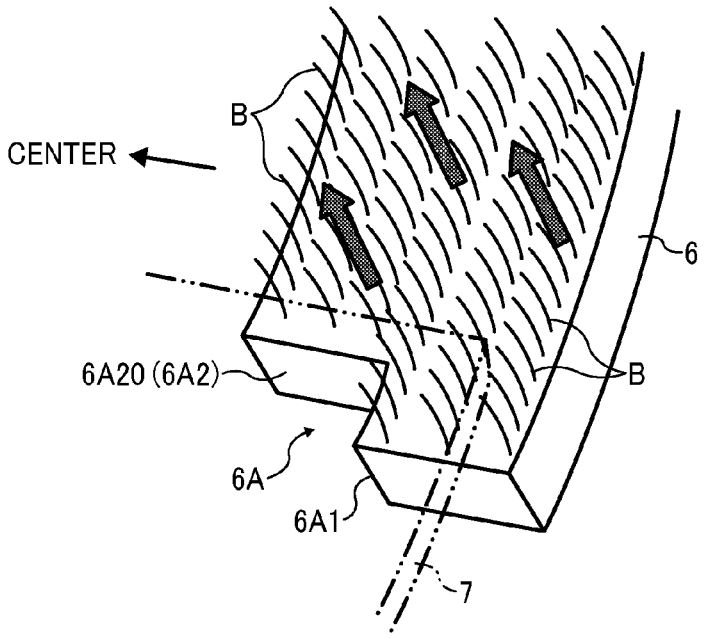
FIG. 6 is a simplified perspective view for describing a surface configuration of the end seal illustrated in FIGS. 5A to 5D, according to an embodiment.

The end seal 6 includes a structure to allow the developer to be headed to the center side in the Y direction using friction force generated at the time of being in contact with the developer bearer 2. That is, as illustrated by the arrows in FIG. 6, the end seal 6 includes, on the surface facing the inlet seal 7, a brush B bristled in a direction to guide the developer toward the center side in the Y direction, which corresponds to the center side (CENTER in FIG. 6) of the developing area. The brush B is provided in the end seal 6 as a configuration that hinders the developer from being moved outside the end seal 6 in the Y direction, by the direction of the bristle. Therefore, the end seals 6 are provided in the developing device 1 as multi-functional components by causing the end seals 6 to have not only the function to shield the leakage of the developer but also a guide function that is different from the shielding function.

Figure 7:
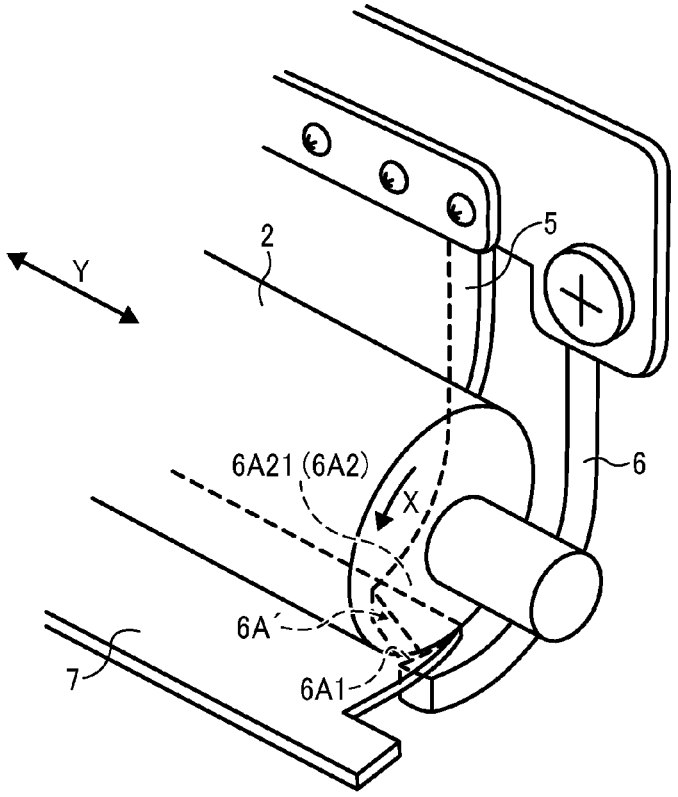
FIG. 7 is a partial perspective view for describing another example of an arrangement of an end seal and an inlet seal used in the developing device illustrated in FIG. 1, based on one end of the developer bearer in the longitudinal direction, according to an embodiment.

Next, another embodiment of a cutout portion (hereinafter, denoted with a reference code 6A' for convenience) in an end seal 6 will be described. In a configuration illustrated in FIGS. 7, and 8A and 8B, a configuration of the cutout portion 6A' provided in the end seal 6 is different. While the cutout portion 6A' includes a parallel edge 6A1 parallel to an X direction, the cutout portion 6A' includes an inclined edge 6A21 inclined toward a downstream side in the X direction with respect to the parallel edge 6A1, as illustrated in FIGS. 7, and 8A and 8B.

Figure 8A:
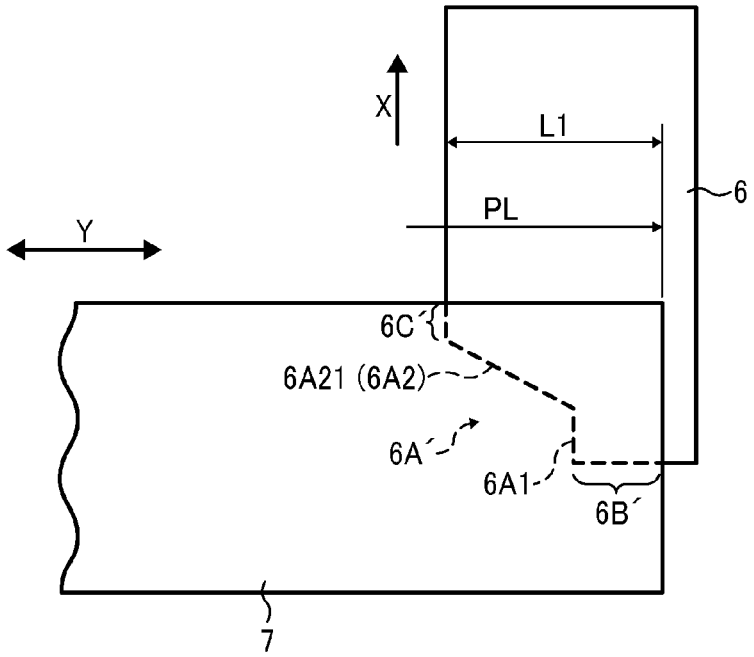
FIGS. 8A and 8B are developed views for describing an opposing relationship between the end seal and the inlet seal illustrated in FIG. 7, according to an embodiment.
Figure 8B:
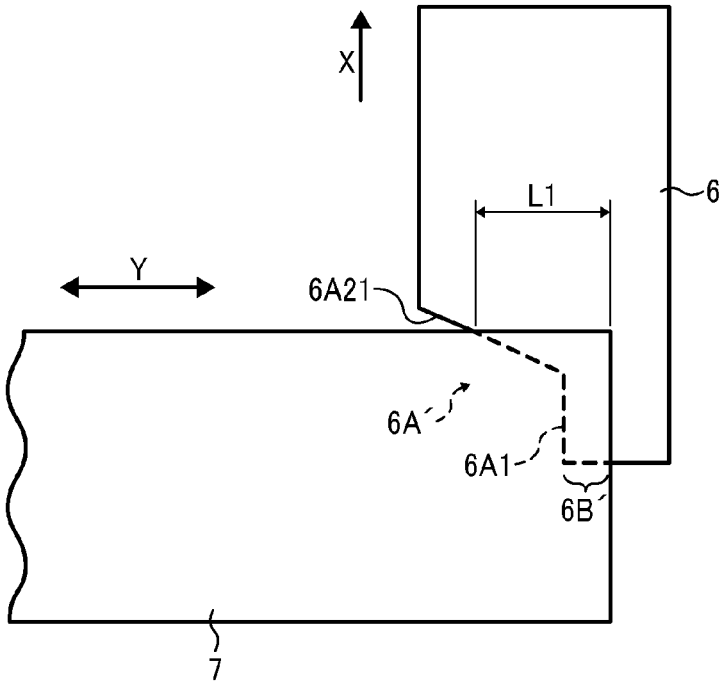

As illustrated in FIGS. 8A and 8B, an inlet seal 7 includes a covered portion 6B' and a covered portion 6C' that cover the end seal 6 to include the cutout portion 6A' in the X direction and in a Y direction. In this configuration, the inlet seal 7 includes the inclined edge 6A21 intersecting with the parallel edge 6A1. Therefore, the inlet seal 7 causes an action to move a developer along the inclined edge 6A21 to surpass an action to move the developer by the end seal 6 as illustrated in FIG. 3. That is, the developer between the inlet seal 7 and a developer bearer 2 in the cutout portion 6A' is easily guided to a center side in the Y direction using rolling friction of the developer bearer 2 that is rotated while being in contact with the inlet seal 7. Therefore, the inclined edge 6A21 functions as a guide surface of the developer, instead of the perpendicular edge 6A20 illustrated in FIGS. 5A to 5D, where a case of causing the gap S has been described. Therefore, deposition of the developer is suppressed, and damage to the developer bearer 2 and occurrence of an abnormal image can be prevented or suppressed.

As illustrated in FIG. 8A, the covered portion 6C' is included between the cutout portion 6A' and the inlet seal 7 so as not to cause a gap (see the reference code S in FIGS. 5B to 5D) in the X direction. In the case of including the covered portion 6C', an area length L1 where the end seal 6 and the inlet seal 7 overlap can be made long in the Y direction, and shielding efficiency can be improved. FIG. 8B illustrates a state where no covered portion 6C' is included. When the inlet seal 7 contacts the end seal 6, the area length L1 where the end seal 6 and the inlet seal 7 overlap becomes shorter than the case of FIG. 8A in the Y direction. Therefore, as for leakage of the developer between the end seal 6 and the inlet seal 7 (movement in the direction illustrated by the reference code PL) from the center side toward an end side in the Y direction, the shielding efficiency becomes worse as the overlapping length of the seals 6 and 7 becomes shorter in the Y direction, and the shielding efficiency becomes better as the overlapping length becomes longer.

As illustrated in FIG. 8A, in a case where the inlet seal 7 is arranged not to cause the gap S into which the developer enters, the overlapping length of the end seal 6 and the inlet seal 7 in the Y direction is made long, so that the movement of the developer from the center toward the end side in the Y direction can be easily suppressed. Therefore, the developer can be almost certainly prevented from scattering from the end seal 6 toward an outside. Meanwhile, as illustrated in FIG. 8B, even in a case where the inlet seal 7 is arranged to cause the gap S into which the developer enters, the inclined edge 6A21 is provided, so that the developer can be smoothly moved toward the center in the Y direction, unlike the case of including the crossing edge, as illustrated in FIG. 5B. Therefore, the developer is prevented or suppressed from being stopped at the position of the end seal 6, and the scattering of the developer in the end in the Y direction can be prevented or suppressed. That is, even in a case where the overlapping area length L1 is shorter than the case illustrated in FIG. 8A, the scattering of the developer in the end in the Y direction can be prevented or suppressed, by providing the inclined edge 6A21.

Figure 9A:
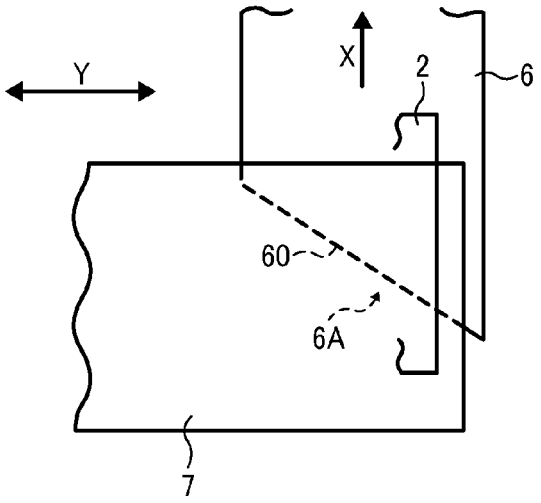
FIGS. 9A to 9C are developed views for describing another example of an arrangement of an end seal and an inlet seal used in the developing device illustrated in FIG. 1, according to an embodiment.
Figure 9B:
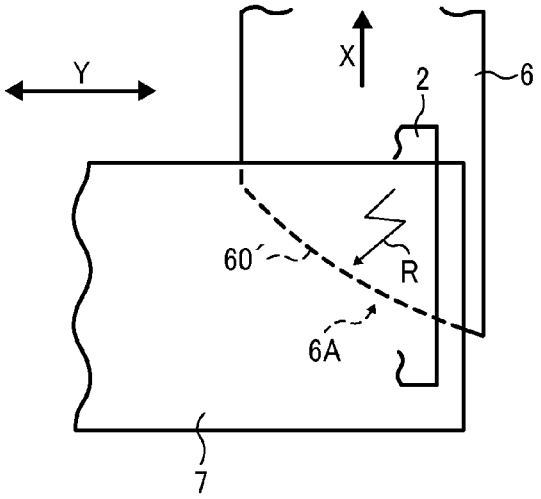
Figure 9C:
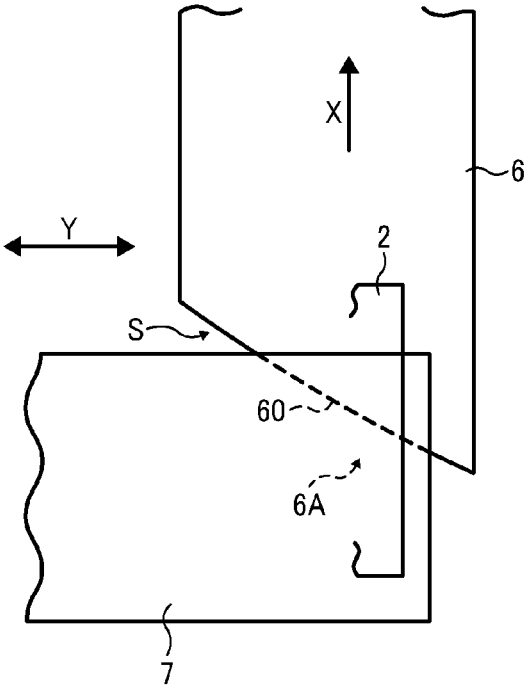

The parallel edge 6A1 of the cutout portion 6A or 6A', which is parallel to the X direction, nearly accord with an end face of the developer bearer 2 in the Y direction, in a horizontal section in the Y direction. To be more accurate, the parallel edge 6A1 is provided with a play (gap) not to cause a rotational load of the developer bearer 2 at a slightly end side in the Y direction of the end face of the developer bearer 2 such that the parallel edge 6A1 and the end face become parallel. Accordingly, when a peripheral surface of the end of the developer bearer 2 presses the inlet seal 7, the inlet seal 7 is bent, and the bending is meshed with the parallel edge 6A1, so that the rotational load of the developer bearer 2 is reduced, and the developer is prevented from being scattered toward an outside of the developing device. However, the end seal 6 may not necessarily include the parallel edge 6A1 as long as the end seal 6 has sufficient flexibility, and can reduce the rotational load of the developer bearer 2 and prevent the developer from being scattered toward an outside of the developing device. For example, an example illustrated in FIGS. 9A to 9C can be exemplified as a form of an edge of the cutout portion 6A. That is, the edge of the cutout portion 6A is inclined with respect to the X direction and the Y direction, and may be formed of a linear inclined edge 60 (see FIG. 9A) that expands the width of the end seal 6 in the Y direction toward the downstream side in the X direction, or a curved inclined edge 60' (see FIG. 9B) having a radius of curvature R. With the configuration, even if the developer between the developer bearer 2 and the inlet seal 7 is spread outside the end of the developer bearer 2, the developer is moved toward the center in the Y direction by the inclined edge 60 or 60' of the end seal 6 existing outside the end of the developer bearer 2. Therefore, the developer can be prevented from being scattered to an outside of the developing device. Further, in this example, the inlet seal 7 may be arranged to cause the gap S into which the developer enters, as illustrated in FIG. 9C. Note that, in such a configuration, the covered portion 6B is not included. However, the above-described sealant (encapsulant) can be applied to a one-side position in the Y direction, in an upstream-side end in the X direction, which corresponds to a starting end of the inclined edge.

Figure 10A:
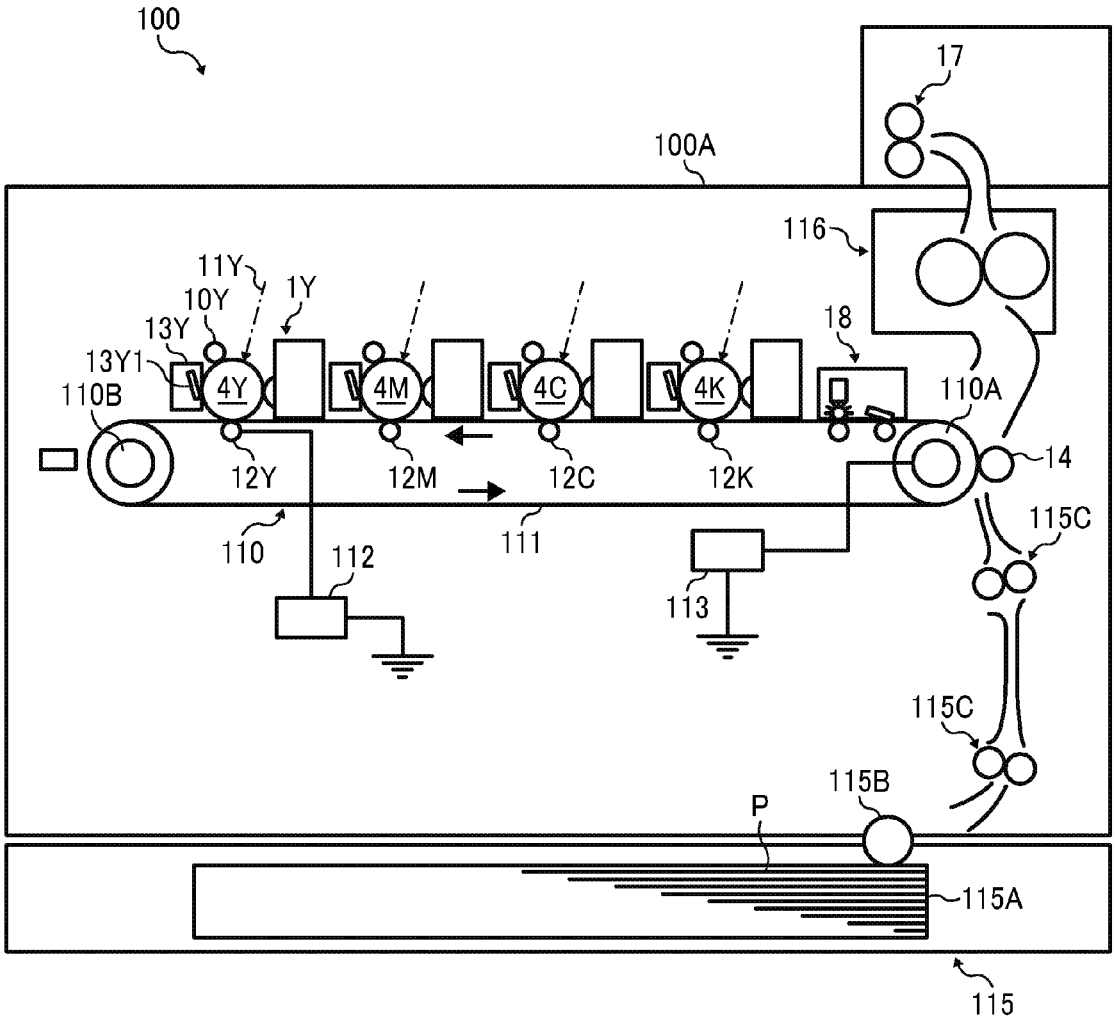
FIGS. 10A and 10B are schematic views for describing an example of an image forming apparatus including a process cartridge into which an example of a developing device according to an embodiment of the present invention is incorporated.
Figure 10B:
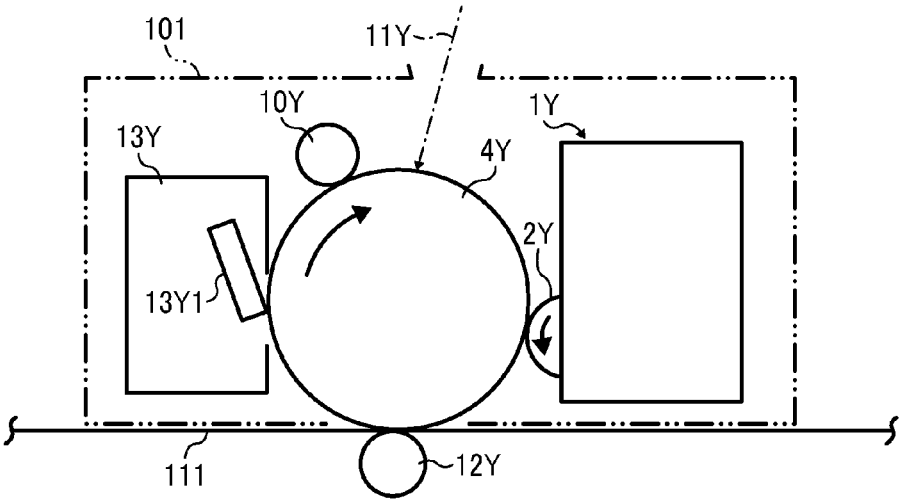

A developing device 1 including the above configuration may be incorporated in a process cartridge 101 illustrated in FIG. 10B, which is detachably provided in an image forming apparatus 100, as an image forming unit of the image forming apparatus 100 illustrated in FIG. 10A. The image forming apparatus 100 illustrated in FIG. 10A, for example, is a printer that includes image forming units of a plurality of colors, that is, respective colors of yellow, magenta, cyan, and black, and can form a color image. The process cartridges 101 are provided corresponding to the respective colors. The process cartridges 101 include photoconductor drums 4Y, 4M, 4C, and 4K (for convenience, displayed with the reference numeral 4 used in FIG. 1 with alphabets representing the meaning of colors) that are latent image bearers. The photoconductor drums 4Y, 4M, 4C, and 4K of the process cartridges 101 are arranged side by side along one of stretched faces of an intermediate transfer belt 111 provided in an intermediate transfer device 110. The intermediate transfer belt 111 is stretched over drive rollers 110A and 110B, and is moved in the direction of the illustrated arrows.

Configurations of the process cartridges 101 are the same. Therefore, the configuration is given as follows, based on the yellow image forming unit having the photoconductor drum 4Y. A charging device 10Y, a writing device 11Y, a developing device 1Y, a primary transfer device 12Y, and a cleaning device 13Y for executing image forming processing in accordance with rotation of the photoconductor drum 4Y are arranged around the photoconductor drum 4Y. The developing device 1Y includes a developing bearer 2Y. Note that the reference code 13Y1 represents a cleaning blade equipped with the cleaning device 13Y in FIG. 10B. The devices except the writing device 11Y and the primary transfer device 12Y, of the charging device 10Y, the writing device 11Y, the developing device 1Y, the primary transfer device 12Y, and the cleaning device 13Y, are collectively housed in the process cartridge 101, as illustrated in FIG. 10B.

In FIG. 10A, images formed in the respective process cartridges 101 are sequentially transferred to the intermediate transfer belt 111 by the primary transfer devices 12Y, 12M, 12C, and 12K to become a superimposed image. A secondary transfer device 14 for collectively transferring the superimposed image to a recording medium P such as a recording sheet is disposed opposite to the intermediate transfer belt 111. The primary transfer devices 12Y, 12M, 12C, and 12K, and the secondary transfer device 14 execute transfer of the images by power supply from transfer bias supplies 112 and 113. Inside the image forming apparatus 100, a feeding device 115 of the recording medium is provided. The feeding device 115 includes a pick-up roller 115B that draws the recording medium from cassettes 115A and 115A that house the recording medium P such as a recording sheet, and conveyors 115C that conveys the drawn recording medium P toward the position of the secondary transfer device 14.

The recording medium P to which the collective transfer by the secondary transfer has been terminated, receives image fixing by a fixing device 116, and is then discharged to a sheet ejection part 100A through ejection rollers 17. When the intermediate transfer belt 111 is moved to the position where the collective transfer is terminated, untransferred toner and foreign substance are cutout by a belt cleaning device 18, and the intermediate transfer belt 111 stands by for image transfer again.

As described above, favorable embodiments of the present invention have been described. However, the present invention is not limited to the specific embodiments, and various modifications/changes can be made within the scope of the gist of the present invention described in claims unless specifically limited in the above description. For example, by use of a shape memory alloy for the inlet seal, a damming phenomenon of the developer according to the amount of deposition of the developer may be avoided. That is, chances of rubbing of the inlet seal by the developer bearer are increased as the amount of the deposition of the developer becomes larger, and frictional heat is more likely to be generated. Therefore, the inlet seal is formed such that the amount of bending becomes larger as the frictional heat is larger so that the damming of the developer can be easily eliminated. Then, prevention or suppression of the scattering of the developer can be expected, using the fact that the amount of deposition of the developer becomes large and the inlet seal becomes a temperature of a predetermined initial state by the frictional heat by rubbing of the developer, so that the dammed developer is flicked off. The effects described in the embodiments of the present invention are a mere list of most favorable effects caused from the present invention, and the effects of the present invention are not limited to those described in the embodiments of the present invention.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A developing device comprising:

a developer bearer;

an end seal disposed in contact with a circumferential surface of each end of the developer bearer in a longitudinal direction of the developer bearer; and an inlet seal including a center portion in the longitudinal direction disposed in contact with the developer bearer and each end in the longitudinal direction disposed in contact with the end seal, the end seal including a cutout portion at a side closer to the center portion in the longitudinal direction and at an upstream side in a direction of rotation of the developer bearer, the inlet seal covering an edge of the cutout portion in the longitudinal direction, wherein the end seal extends beyond a terminal end of the developer bearer in the longitudinal direction of the developer bearer and the edge of the cutout portion is aligned with the terminal end of the developer bearer.

2. The developing device according to claim 1, wherein the edge includes:

a parallel edge parallel to the direction of rotation of the developer bearer; and a crossing edge extending from a downstream end of the parallel edge in the direction of rotation toward the center portion in the longitudinal direction, and wherein the crossing edge is a perpendicular edge perpendicular to the parallel edge.

3. The developing device according to claim 2, wherein the parallel edge is disposed at a position that nearly accords with each end of the developer bearer in the longitudinal direction.

4. The developing device according to claim 1, wherein the edge includes:

a parallel edge parallel to the direction of rotation of the developer bearer; and a crossing edge extending from a downstream end of the parallel edge in the direction of rotation toward the center portion in the longitudinal direction, and wherein the crossing edge is an inclined edge inclined toward a downstream side in the direction of rotation with respect to the parallel edge.

5. The developing device according to claim 1, wherein the edge is a linear or curved inclined edge inclined with respect to both the direction of rotation and the longitudinal direction, the linear or curved inclined edge narrowing a width of the end seal in the longitudinal direction toward the upstream side in the direction of rotation.

6. The developing device according to claim 1, wherein the inlet seal covers the edge and one of a covered portion of the end seal at the upstream side in the direction of rotation and a covered portion at the side closer to the center portion in the longitudinal direction, in both the direction of rotation and the longitudinal direction.

7. The developing device according to claim 1, wherein the end seal includes, on a surface facing the inlet seal, a brush bristled in a direction to guide the developer toward the center portion.

8. A process cartridge comprising:

a latent image bearer to bear a latent image;

the developing device according to claim 1 including the developer bearer, to supply developer to the latent image on the latent image bearer to form a visible image on the latent image bearer.

9. An image forming apparatus, comprising the process cartridge according to claim 8.

10. An image forming apparatus, comprising the developing device according to claim 1.

11. A developing device comprising:

a developer bearer;

an end seal disposed in contact with a circumferential surface of each end of the developer bearer in a longitudinal direction of the developer bearer; and an inlet seal including a center portion in the longitudinal direction disposed in contact with the developer bearer and each end in the longitudinal direction disposed in contact with the end seal, the end seal including a cutout portion at a side closer to the center portion in the longitudinal direction and at an upstream side in a direction of rotation of the developer bearer, the inlet seal covering an edge of the cutout portion in the longitudinal direction, wherein the edge includes:

a parallel edge parallel to the direction of rotation of the developer bearer; and a crossing edge extending from a downstream end of the parallel edge in the direction of rotation toward the center portion in the longitudinal direction, and wherein the crossing edge is an inclined edge inclined toward a downstream side in the direction of rotation with respect to the parallel edge.

12. A developing device comprising:

a developer bearer;

an end seal disposed in contact with a circumferential surface of each end of the developer bearer in a longitudinal direction of the developer bearer; and an inlet seal including a center portion in the longitudinal direction disposed in contact with the developer bearer and each end in the longitudinal direction disposed in contact with the end seal, the end seal including a cutout portion at a side closer to the center portion in the longitudinal direction and at an upstream side in a direction of rotation of the developer bearer, the inlet seal covering an edge of the cutout portion in the longitudinal direction, wherein the edge is a linear or curved inclined edge inclined with respect to both the direction of rotation and the longitudinal direction, the linear or curved inclined edge narrowing a width of the end seal in the longitudinal direction toward the upstream side in the direction of rotation.

* * * * *